US008091775B2

(12) United States Patent
Zierolf

(10) Patent No.: US 8,091,775 B2
(45) **Date of Patent: *Jan. 10, 2012**

(54) PROCESS AND ASSEMBLY FOR IDENTIFYING AND TRACKING ASSETS

(75) Inventor: Joseph A. Zierolf, Houma, LA (US)

(73) Assignee: Marathon Oil Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/725,254

(22) Filed: Mar. 16, 2010

(65) Prior Publication Data

US 2010/0171593 A1 Jul. 8, 2010

Related U.S. Application Data

(63) Continuation of application No. 11/377,736, filed on Mar. 16, 2006, now Pat. No. 7,677,439, which is a continuation of application No. 09/843,998, filed on Apr. 27, 2001, now Pat. No. 7,014,100.

(51) Int. Cl.
*G06F 17/00* (2006.01)

(52) U.S. Cl. ..... 235/375; 343/719

(58) Field of Classification Search ..... 235/375, 235/385, 438, 445, 487; 343/719
See application file for complete search history.

(56) References Cited

U.S. PATENT DOCUMENTS

| | | | | |
|---|---|---|---|---|
| 3,684,008 | A | | 8/1972 | Garrett |
| 3,706,094 | A | | 12/1972 | Cole et al. |
| 4,023,167 | A | | 5/1977 | Wahlstrom |
| 4,096,477 | A | | 6/1978 | Epstein et al. |
| 4,119,146 | A | | 10/1978 | Taylor |
| 4,166,215 | A | | 8/1979 | Anderson |
| 4,535,430 | A | | 8/1985 | Cochrane et al. |
| 4,572,293 | A | | 2/1986 | Wilson et al. |
| 4,599,182 | A | | 7/1986 | Young et al. |
| 4,622,463 | A | | 11/1986 | Hill |
| 4,630,044 | A | | 12/1986 | Polzer |
| 4,656,463 | A | | 4/1987 | Anders et al. |
| 4,656,944 | A | * | 4/1987 | Gonzalez ..... 102/312 |
| 4,698,631 | A | | 10/1987 | Kelly, Jr. et al. |

(Continued)

FOREIGN PATENT DOCUMENTS

EP 0013494 A1 7/1980

(Continued)

OTHER PUBLICATIONS

Den-Con Tool Co., General Catalog, 1994-95, pp. 1-3.

(Continued)

*Primary Examiner* — Edwyn Labaze
(74) *Attorney, Agent, or Firm* — Jack E. Ebel

(57) ABSTRACT

An assembly and process for identifying and tracking assets, such as tubulars, equipment, tools and/or devices. An antenna is electrically connected to a responding device, such as a radio frequency identification device, and this assembly is connected to an asset. The antenna may be positioned about the exterior and/or the interior of the asset and significantly increases the range of signals that may be received and/or broadcast by the responding device. A transceiver may accordingly be positioned a greater distance from the asset without regard to the orientation of the asset and still permit communication between the transceiver and the responding device. In this manner, information that specifically identifies the asset may be compiled in a data base so as to maintain an accurate history of the usage of such assets as tubulars, equipment, tool and/or devices.

17 Claims, 4 Drawing Sheets

U.S. PATENT DOCUMENTS 4,808,925 A 2/1989 Baird
4,827,395 A 5/1989 Anders et al.
4,837,515 A 6/1989 Nishihara et al.
4,977,961 A 12/1990 Avasthi
5,029,644 A 7/1991 Szarka
5,105,742 A 4/1992 Sumner
5,130,705 A 7/1992 Allen et al.
5,142,128 A 8/1992 Perkin et al.
5,160,925 A 11/1992 Dailey et al.
5,191,936 A 3/1993 Edwards et al.
5,202,680 A 4/1993 Savage
5,206,680 A 4/1993 Dillow
5,230,387 A 7/1993 Waters et al.
5,279,366 A 1/1994 Scholes
5,354,956 A 10/1994 Orban et al.
5,355,957 A 10/1994 Burleson et al.
5,361,838 A 11/1994 Kilgore
5,394,141 A 2/1995 Soulier
5,457,447 A 10/1995 Ghaem et al.
5,467,083 A 11/1995 McDonald et al.
5,479,860 A 1/1996 Ellis
5,495,237 A 2/1996 Yuasa et al.
5,497,140 A 3/1996 Tuttle
5,505,134 A 4/1996 Brooks et al.
5,530,358 A 6/1996 Wisler et al.
5,608,199 A 3/1997 Clouse, III et al.
5,621,647 A 4/1997 Kraemer et al.
5,626,192 A 5/1997 Connell et al.
5,629,623 A 5/1997 Sezginer et al.
5,654,693 A 8/1997 Cocita
5,660,232 A 8/1997 Reinhardt
5,680,459 A 10/1997 Hook et al.
5,680,905 A 10/1997 Green et al.
5,682,099 A 10/1997 Thompson et al.
5,682,143 A 10/1997 Brady et al.
5,706,896 A 1/1998 Tubel et al.
5,720,345 A 2/1998 Price et al.
5,829,538 A 11/1998 Wesson et al.
5,836,406 A 11/1998 Schuh
5,864,323 A 1/1999 Berthon
5,877,996 A 3/1999 Krokstad et al.
5,911,277 A 6/1999 Hromas et al.
5,923,167 A 7/1999 Chang et al.
5,931,239 A 8/1999 Schuh
5,939,885 A 8/1999 McClure et al.
5,955,666 A 9/1999 Mullins
5,991,602 A 11/1999 Sturm
5,995,449 A 11/1999 Green et al.
6,018,501 A 1/2000 Smith et al.
6,025,780 A 2/2000 Bowers et al.
6,078,259 A 6/2000 Brady et al.
6,081,729 A 6/2000 Bauerschmidt et al.
6,085,805 A 7/2000 Bates
6,097,301 A 8/2000 Tuttle
6,105,688 A 8/2000 Vaynshteyn et al.
6,135,206 A 10/2000 Gano et al.
6,151,961 A 11/2000 Huber et al.
6,158,532 A 12/2000 Logan et al.
6,176,318 B1 1/2001 Drakeley et al.
6,184,685 B1 2/2001 Paulk et al.
6,189,621 B1 2/2001 Vail, III
6,243,041 B1 * 6/2001 Mischenko et al. ..... 343/702
6,249,258 B1 6/2001 Bloch et al.
6,253,842 B1 7/2001 Connell et al.
6,257,338 B1 7/2001 Kilgore
6,288,548 B1 9/2001 Thompson et al.
6,288,685 B1 9/2001 Thomas
6,324,904 B1 12/2001 Ishikawa et al.
6,333,699 B1 12/2001 Zierolf
6,333,700 B1 12/2001 Thomeer et al.
6,343,649 B1 2/2002 Beck et al.
6,359,569 B2 3/2002 Beck et al.
6,366,089 B1 4/2002 Poitzsch et al.
6,426,917 B1 7/2002 Tabanou et al.
6,429,653 B1 8/2002 Kruspe et al.
6,443,228 B1 9/2002 Aronstam et al.
6,450,258 B2 9/2002 Green et al.
6,476,609 B1 11/2002 Bittar
6,481,505 B2 11/2002 Beck et al.
6,497,280 B2 12/2002 Beck et al.
6,515,919 B1 2/2003 Lee
6,531,871 B1 3/2003 Hay et al.
6,536,524 B1 * 3/2003 Snider ..... 166/297
6,575,237 B2 6/2003 Purkis et al.
6,577,244 B1 6/2003 Clark et al.
6,588,505 B2 7/2003 Beck et al.
6,597,175 B1 7/2003 Brisco
6,614,229 B1 9/2003 Clark et al.
6,717,501 B2 4/2004 Hall et al.
6,759,968 B2 7/2004 Zierolf
6,761,219 B2 7/2004 Snider et al.
6,766,703 B1 7/2004 Kluth et al.
6,788,263 B2 9/2004 Clark et al.
6,822,579 B2 11/2004 Goswami et al.
6,915,848 B2 7/2005 Thomeer et al.
6,943,697 B2 9/2005 Ciglenec et al.
6,989,764 B2 1/2006 Thomeer et al.
7,014,100 B2 3/2006 Zierolf
7,063,148 B2 6/2006 Jabusch
7,159,654 B2 1/2007 Ellison et al.
7,268,688 B2 9/2007 Juds
7,283,061 B1 10/2007 Snider et al.
7,400,263 B2 7/2008 Snider et al.
7,677,439 B2 3/2010 Zierolf
7,714,741 B2 5/2010 Snider et al.
2001/0013410 A1 8/2001 Beck et al.
2001/0013411 A1 8/2001 Beck et al.
2001/0042617 A1 11/2001 Beck et al.
2001/0043146 A1 11/2001 Beck et al.
2001/0054969 A1 12/2001 Thomeer et al.
2002/0007949 A1 1/2002 Tolman et al.
2002/0014966 A1 2/2002 Strassner et al.
2002/0093431 A1 7/2002 Zierolf
2002/0133942 A1 9/2002 Kenison et al.
2002/0158120 A1 10/2002 Zierolf
2003/0058125 A1 3/2003 Ciglenec et al.
2003/0090390 A1 5/2003 Snider et al.
2004/0211567 A1 10/2004 Aud
2004/0239521 A1 12/2004 Zierolf
2005/0115708 A1 6/2005 Jabusch
2005/0237200 A1 10/2005 Bellum et al.
2006/0175404 A1 8/2006 Zierolf
2008/0271887 A1 11/2008 Snider et al.
2009/0223663 A1 9/2009 Snider et al.
2009/0223670 A1 9/2009 Snider
2010/0013664 A1 1/2010 Zierolf
2010/0219980 A1 9/2010 Snider et al.

FOREIGN PATENT DOCUMENTS

EP 0412535 B1 2/1991
EP 0651132 A2 5/1995
EP 0730083 A2 9/1996
FR 1033631 7/1953
SU 1657627 A1 6/1991
WO 01/18357 A2 3/2001
WO 01/73423 A1 10/2001
WO 2006/101618 A2 9/2006
WO 2009/114356 A1 9/2009

OTHER PUBLICATIONS

Varpakhovich G A; RU2057334C1: Method of Identification of Objects and Plant for its Realization; Mar. 27, 1996; pp. 1-2; Derwent Record.
U.S. Office Communication from U.S. Appl. No. 09/586,648 dated Dec. 18, 2003.
U.S. Office Communication from U.S. Appl. No. 09/586,648 dated Aug. 26, 2004.
U.S. Notice of Allowance from U.S. Appl. No. 09/586,648 dated Sep. 29, 2005.
U.S. Office Communication from U.S. Appl. No. 10/323,536 dated Dec. 27, 2006.
U.S. Office Communication from U.S. Appl. No. 10/323,536 dated May 14, 2007.
U.S. Notice of Allowance from U.S. Appl. No. 10/323,536 dated Feb. 5, 2008.

U.S. Supplemental Notice of Allowance from U.S. Appl. No. 10/323,536 dated Apr. 11, 2008.
U.S. Office Communication from U.S. Appl. No. 12/173,693 dated Feb. 25, 2009.
U.S. Office Communication from U.S. Appl. No. 12/173,693 dated Jun. 4, 2009.
U.S. Notice of Allowability from U.S. Appl. No. 12/173,693 dated Aug. 21, 2009.
U.S. Office Communication from U.S. Appl. No. 09/843,998 dated Aug. 29, 2002.
U.S. Office Communication from U.S. Appl. No. 09/843,998 dated Mar. 28, 2003.
U.S. Office Communication from U.S. Appl. No. 09/843,998 dated Dec. 9, 2003.
U.S. Office Communication from U.S. Appl. No. 09/843,998 dated Jul. 28, 2004.
U.S. Office Communication from U.S. Appl. No. 09/843,998 dated Mar. 24, 2005.
U.S. Office Communication from U.S. Appl. No. 11/377,736 dated Oct. 18, 2006.
U.S. Office Communication from U.S. Appl. No. 11/377,736 dated May 7, 2007.
U.S. Office Communication from U.S. Appl. No. 11/377,736 dated Nov. 1, 2007.
U.S. Office Communication from U.S. Appl. No. 11/377,736 dated Jun. 12, 2008.
U.S. Office Communication from U.S. Appl. No. 11/377,736 dated Dec. 12, 2008.
U.S. Office Communication from U.S. Appl. No. 11/377,736 dated May 29, 2009.
U.S. Notice of Allowability from U.S. Appl. No. 09/286,650 dated Jul. 3, 2000.
U.S. Notice of Allowability from U.S. Appl. No. 09/286,650 dated Jan. 12, 2001.
U.S. Supplemental Notice of Allowability from U.S. Appl. No. 09/286,650 dated Oct. 12, 2001.
U.S. Office Communication from U.S. Appl. No. 09/656,720 dated Feb. 26, 2002.
U.S. Office Communication from U.S. Appl. No. 10/032,114 dated Aug. 13, 2003.
U.S. Notice of Allowability from U.S. Appl. No. 10/032,114 dated Feb. 24, 2004.
U.S. Office Communication from U.S. Appl. No. 10/887,366 dated Dec. 5, 2006.
U.S. Office Communication from U.S. Appl. No. 10/887,366 dated May 17, 2007.
U.S. Office Communication from U.S. Appl. No. 10/887,366 dated Aug. 21, 2007.
U.S. Office Communication from U.S. Appl. No. 10/887,366 dated Nov. 23, 2007.
U.S. Office Communication from U.S. Appl. No. 10/887,366 dated Jun. 18, 2008.
U.S. Office Communication from U.S. Appl. No. 10/887,366 dated Nov. 10, 2008.
U.S. Office Communication from U.S. Appl. No. 10/887,366 dated Apr. 22, 2009.
U.S. Office Communication from U.S. Appl. No. 10/726,027 dated Jul. 11, 2005.
U.S. Office Communication from U.S. Appl. No. 12/044,087 dated Apr. 22, 2010.
U.S. Office Communication from U.S. Appl. No. 12/044,087 dated Jul. 30, 2010.
U.S. Office Communication from U.S. Appl. No. 12/102,687 dated Aug. 2, 2010.
U.S. Office Communication from U.S. Appl. No. 12/044,087 dated Jan. 13, 2011.
U.S. Office Communication from U.S. Appl. No. 12/102,687 dated Nov. 5, 2010.
U.S. Office Communication from U.S. Appl. No. 12/102,687 dated Apr. 6, 2011.
U.S. Office Communication from U.S. Appl. No. 12/564,780 dated Mar. 16, 2011.
U.S. Office Communication from U.S. Appl. No. 12/044,087 dated May 24, 2011.

* cited by examiner

PROCESS AND ASSEMBLY FOR IDENTIFYING AND TRACKING ASSETS

CROSS REFERENCE TO RELATED APPLICATIONS

This application is a continuation of U.S. patent application Ser. No. 11/377,736, filed on Mar. 16, 2006, entitled "Process and Assembly for Identifying and Tracking Assets", and issued as U.S. Pat. No. 7,677,439, which is a continuation of U.S. patent application Ser. No. 09/843,998, which was filed on Apr. 27, 2001, entitled "Process and Assembly for Identifying and Tracking Assets", and has issued as U.S. Pat. No. 7,014,100.

This application is related to the following copending patent applications: U.S. patent application Ser. No. 12/044,087, filed on Mar. 7, 2008 and entitled "Systems, Assemblies and Processes for Controlling Tools in a Well Bore"; U.S. patent application Ser. No. 12/102,687, filed on Apr. 14, 2008 and entitled "Systems, Assemblies and Processes for Controlling Tools in a Well Bore"; U.S. patent application Ser. No. 12/173,693, filed on Jul. 15, 2008, entitled "Method and System for Performing Operations and for Improving Production in Wells" and issued as U.S. Pat. No. 7,714,741; U.S. patent application Ser. No. 12/564,780, filed on Sep. 22, 2009 and entitled "Method and Apparatus for Determining Position in a Pipe"; and U.S. patent application Ser. No. 12/777,779, filed on May 11, 2010 and entitled "Method and System for Performing Operations and for Improving Production in Wells".

BACKGROUND OF THE INVENTION

1. Field of the Invention

The present invention relates to processes and assemblies for identifying and tracking assets, such as tubulars, equipment and tools used in subterranean wells, and more particularly, to processes and assemblies for identifying and tracking such assets which facilitates accurate input of data into a data base.

2. Description of Related Art

Tubulars are commonly employed in subterranean wells. During drilling of a subterranean well bore, a drill bit is secured to one end of a drill string which is made up of individual lengths of drill pipe. These lengths are conventionally secured together by means of a threaded collar. After the drill bit is secured to a first length of drill pipe, the bit and first length of drill pipe are lowered to the ground and usually rotated to permit the bit to penetrate the earth. Drilling fluid is circulated via the interior of the pipe to the drill bit to lubricate the bit and to carry cuttings back to the drilling rig at the surface of the earth via the annulus formed between the bore hole being drilled and the drill pipe. As drilling progresses, additional lengths of drill pipe are secured to the uppermost length of drill pipe in the well bore. As this process continues, a drill string is formed that is made up of individual lengths of drill pipe secured together. Once the well bore is drilled to the desired depth, the well bore is completed by positioning a casing string within the well bore to increase the integrity thereof and provide a path for producing fluids to the surface. The casing string is normally made up of individual lengths of relatively large diameter metal tubulars which are secured together by any suitable means, for example screw threads or welds. Usually, each length of casing is provided with male screw threads at each end thereof and individual lengths of casing are joined together by means of a collar having female screw threads at each end thereof. Conventionally, after the casing string is cemented to the well bore face and perforated to establish fluid communication between the subterranean formation and the interior of the casing string, a production tubing string is positioned within the casing string to convey fluids produced into the well to the surface of the earth. Tubing strings are conventionally made up of individual lengths of relatively small diameter tubing secured together by collars in a manner as described above with respect to casing. Tubing strings may also be used to convey fluids to treat the well or a subterranean formation of interest or to convey tools or equipment, such as packers, plugs, etc., that are needed to complete or work over a well.

Tubulars are transported to the well site in anticipation of an operation and are temporarily stored there until deployed into a well. At the well site, each length of tubular is measured or tagged to determine the exact length thereof. Because each tubular as manufactured usually varies in length, it is important to determine and know the exact length thereof so that the total length of a given tubular string that is positioned in a subterranean well is known. As the first tubular of a given string is positioned in a well, the tubular is designated with a first number, e.g. 1, and the length thereof is manually recorded at the well site into either a paper or computer data base. As each subsequent individual length of tubular is secured to the tubular string already positioned in the well, the next consecutive number that is assigned to that tubular and its exact length is also manually recorded into the data base at the well site. In this manner, the exact number of tubulars that make up a given string positioned in a subterranean well and the exact length of the string is known. The compilation of a data base in this manner is also desirable so as to maintain an accurate history of the usage of tubulars, equipment and/or tools. Such history of usage can be used to provide maintenance and predict potential problems. However, problems routinely occur with this procedure due to manual error(s) in entering into the data base tubular length(s) that are not part of the tubular string positioned in a well, in entering the wrong sequence of individual tubular lengths that make up a string, and/or in failing to enter an individual tubular length(s) that is part of a tubular string positioned in a subterranean well. Such errors lead to time consuming problem solving, while expensive rigs are often present at the well site, to determine the precise depth of the well, of a certain individual length of casing, and/or of a certain downhole tool. Further problems occur with this conventional method when tubulars are withdrawn from the well bore, temporarily stored on site and subsequently used in a different operation at that well or transported and used in a different well. In accordance with this conventional method, individual lengths of tubulars removed from a well are stacked at the well site without any consideration given to the number assigned to that tubular as run into the well. The individual length of tubulars are not actually physically marked with a designation number and marking such tubulars as they are being pulled from a well is not practical since the rig necessary for performing this operation is expensive. In some instances, individual lengths of drill pipe are provided with a unique serial number from the manufacturer which is entered into the data base as the drill string is being made up. However, such entry is expensive and plagued by manual errors, and often, the serial number of an individual length of drill pipe is not easily found or illegible if found due to rust, corrosion, wear, etc.

In an effort to automate the data input process and to provide a completely accurate information data base, a system has been developed to track asset inventory wherein an electronic tag, such as a passive radio frequency chip, is attached to articles of manufacture that are used in the oil and gas industry. A hand held wand is employed by field personnel to read such electronic tag and the code gleaned during such reading is transferred by cable to a hand held portable terminal. This information is then sent to a personal computer. This system is commercially available from Den-Con Tool Company of Oklahoma City, Okla. under the trade name designation Print System. However, electronic tags, such as a passive radio frequency chip, do not transmit through steel, and therefore, require field personnel to position the hand held wand adjacent and close to the tag to read it. Thus, the use of this system at field locations, such as drilling and completion rigs, offshore platforms etc., has proven to be inefficient since field personnel must first locate the position of the electronic tag and then properly position the wand in extremely close proximity to the tag, sometimes repeating the procedure to ensure that the tag is properly read. This is time consuming and expensive.

Thus, a need exists for an identification and tracking method wherein individual lengths of tubulars, pieces of equipment or tools are accurately identified and inventoried prior to deployment in a given subterranean well, as positioned in a well and/or as stacked at a well site after being pulled from a well and awaiting deployment in the same or different wells. A further need exists for effectively eliminating errors in data base entry for information about individual lengths of tubulars, equipment and/or tools. A still further need exists for eliminating time delays associated with automated reading of radio frequency identification devices employed to identify and track tubulars or other tools or equipment.

SUMMARY OF THE INVENTION

To achieve the foregoing and other objects, and in accordance with the purposes of the present invention, as embodied and broadly described herein, one characterization of the present invention may comprise an assembly for identifying and tracking an asset. The assembly comprises a responding device adapted to be connected to an asset and an antenna electrically connected to said responding device.

In another characterization of the present invention, an assembly is provided for use as a fluid conduit. The assembly comprises a tubular, a responding device connected to the tubular, and an antenna electrically connected to the responding device.

In yet another characterization of the present invention, an assembly is provided for use as a fluid conduit. The assembly comprises a tubular, a collar releasably secured to one end of the tubular, the collar comprising a generally tubular body, a responding device connected to the generally tubular body, and an antenna electrically connected to the responding device.

In still another characterization of the present invention, a process for identifying and tracking assets is provided which comprises positioning a transceiver in proximity to an asset having a responding device and an antenna electrically connected to the responding device so as to permit communication between the transceiver and the responding device via the antenna.

In yet still another characterization of the present invention, a process for identifying and tracking tubulars is provided which comprises positioning a transceiver and a tubular having a responding device and an antenna electrically connected to the responding device in proximity to each other without regard to the rotational orientation of the tubular so as to permit communication between the transceiver and the responding device via the antenna.

In yet still another characterization of the present invention, a process is provided for identifying and tracking assets which comprises positioning an asset having a responding device connected thereto within a transceiver having a generally annular antenna so as to permit communication between the transceiver and the responding device via said antenna.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE PREFERRED EMBODIMENTS

As utilized throughout this specification, the term asset refers to any article of manufacture or device, which includes, but is not limited to, tubulars, equipment and tools designed to be run on, connected to and/or operated by tubulars. As utilized throughout this specification, the term tubular refers to an individual length of any generally tubular conduit for transporting fluid, particularly oil, gas and/or water in and/or from a subterranean well and/or transportation terminal. When referring to a "tubular" which is used in a subterranean well, tubulars are usually secured together by means of collars to form a string of tubulars, such as a tubing string, drill string, casing string, etc., which is positioned in a subterranean well as utilized, at least in part, to transport fluids. Environments other than a subterranean well in which tubulars may be used in accordance with the present invention, include, but are not limited to, pipelines and sewer lines.

Figure 1A:
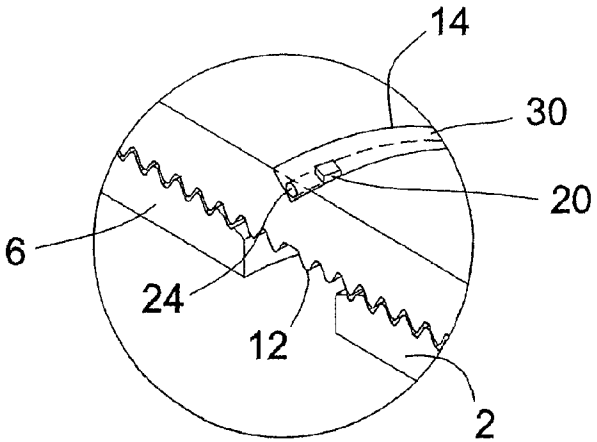
FIG. 1A is a blown up portion, as outlined in FIG. 1, of the embodiment of the process and assembly of the present invention that is illustrated in FIG. 1.
Figure 1:
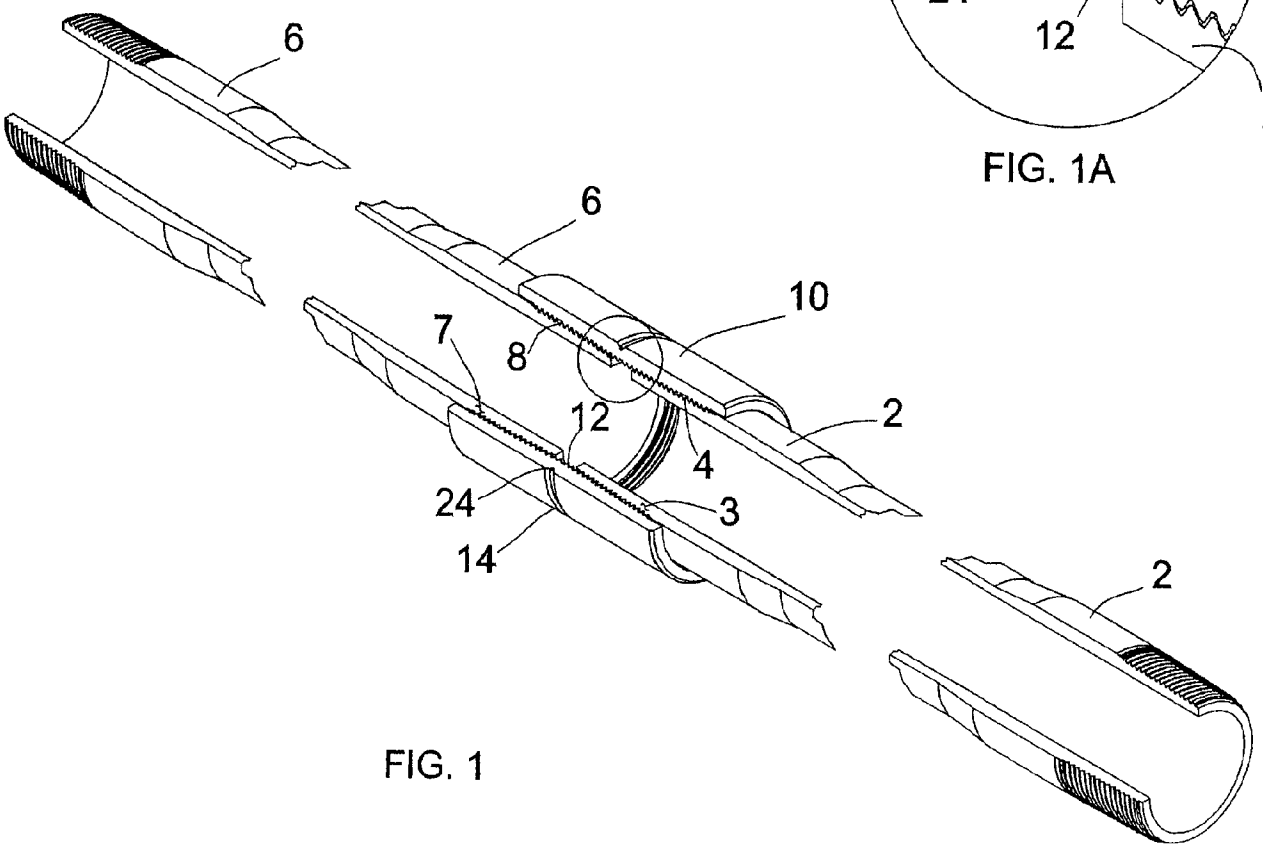
FIG. 1 is a partially cutaway, perspective view of one embodiment of the process and assembly of the present invention.

Referring to FIG. 1, a portion of two tubulars are illustrated as 2 and 6. Each end of tubulars 2 and 6 may be provided with screw threads. As illustrated in FIG. 1, the outer surface of one end 3 and 7 of tubulars 2 and 6, respectively, are provided with screw threads 4 and 8. A collar 10 is utilized to secure ends 3 and 7 of tubulars 2 and 6 together. The internal surface of collar 10 is provided with screw threads 12 which threads 4 and 8 are mated with.

In accordance with the embodiment of the present invention as illustrated in FIG. 1, the outer surface of collar 10 is provided with a groove or trough 14 which extends about substantially the entire circumference or periphery of collar 10. A responding device 20, for example a radio frequency identification device (known as a RFID), is positioned in groove 14. This radio frequency identification device 20 may be in the form of a passive radio identification device (know as a PRID). Such PRIDs are conventional and are used for merchandise security in the retail industry, library security, etc., and generally comprise a solid state printed circuit which is configured to resonate upon receipt of radio frequency energy from a radio transmission of appropriate frequency and strength. Such devices do not require any additional power source, as the energy received from the transmission provides sufficient power for the device to respond with a weak and/or periodic reply transmission so long as it is receiving an appropriate transmission.

Alternatively, the responding device 20 may be in the form of an active device, requiring a separate source of electrical power (e.g., electrical storage battery or other electrical power means). Such devices are also conventional, and may be configured to draw practically no electrical power until a radio frequency signal is received, whereupon they are electrically energized to produce a responding transmission.

In accordance with one embodiment of the present invention, an antenna 24 is electrically connected to the responding device 20 by any suitable means, such as by silver solder or welds, and is positioned within groove 14 and extends about substantially the entire circumference or periphery of collar 10. Antenna 24 may be constructed of any suitable electrically conductive material as will be evident to a skilled artisan, for example suitable nickel based alloys such as INCONEL. Preferably, device 20 and antenna 24 are incorporated in a TEFLON ring which is positioned in groove 14 and forms a fluid tight seal through which an appropriate radio frequency signal may be transmitted and received.

Figure 4:
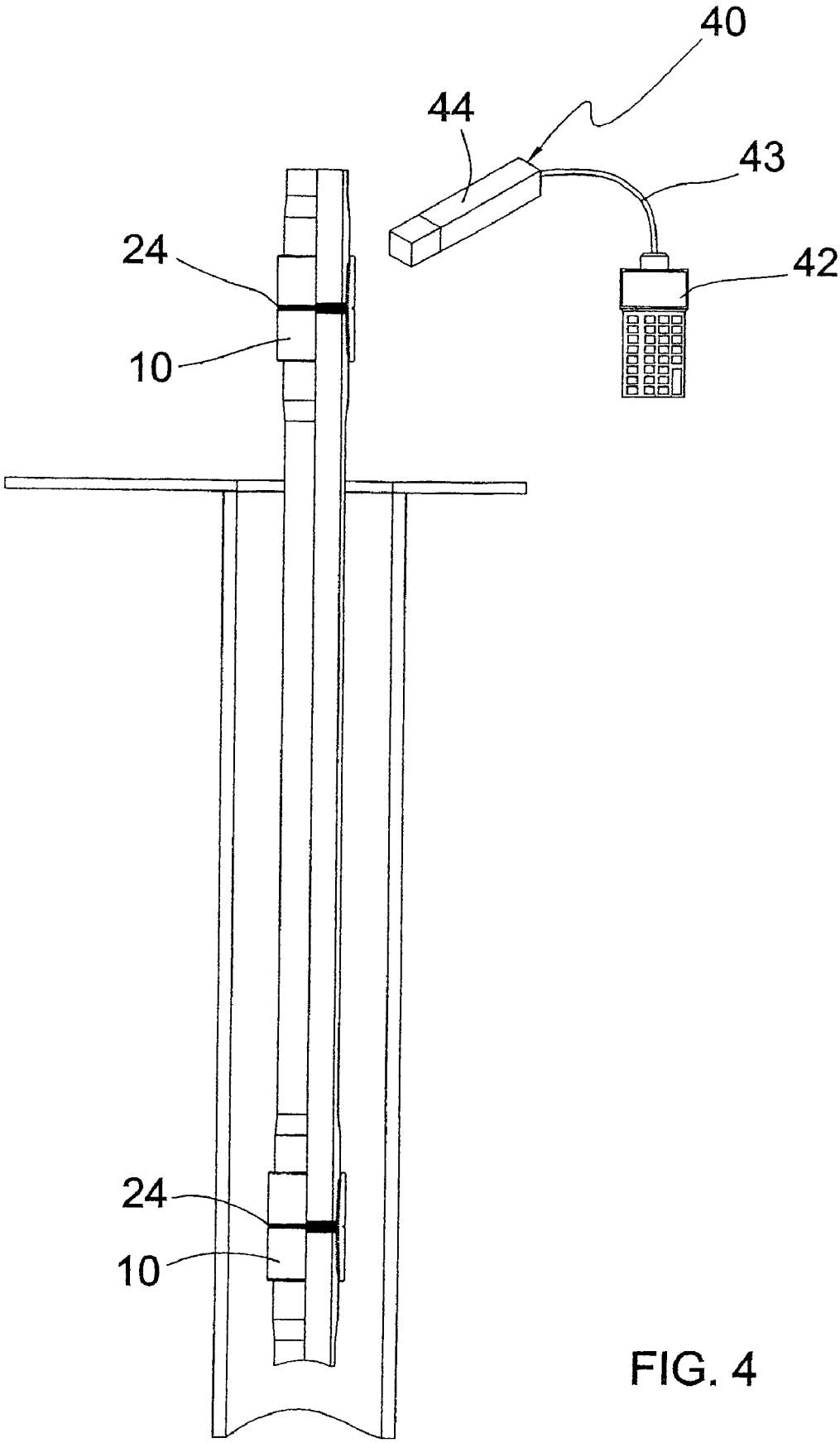
FIG. 4 is a partially sectioned, perspective view of a responding device being read by a transceiver in accordance with the present invention.

A radio frequency transmitter and receiver (i.e. a transceiver) 40 is provided (FIG. 4). Transceiver may be in the form of a hand held portable terminal 42 connected to a hand-held wand 44 by means of cable 43. In operation, as a tubing string that comprises tubulars joined together, for example by collars, is being moved into position for use, wand 44 may be manually held adjacent the tubulars without regard for the specific orientation of a responding device on a given tubular. Alternatively, where the process permits, wand 44 may be secured in a stationary position that is adjacent the tubulars and held in that position by any suitable mechanical means as will be evident to a skilled artisan. Transceiver 40 constantly transmits a radio frequency signal in the direction of the tubing string. As antenna 24 on a given collar 10 passes adjacent wand 44, the signal emanating from wand 44 is received by antenna 24 and transmitted to radio frequency identification device 20. Device 20 detects this signal and sends a radio frequency response that is transmitted through the antenna 24 so as to be received by transceiver 40. In this manner, each tubular joint and its position is identified. By using an antenna in accordance with the present invention not only is the orientation of tubulars (and therefore responding devices) as well as the corresponding transceiver irrelevant, but the antenna is able to receive and broadcast radio frequency signals at greater distances than by using only a radio frequency identification device, e.g. up to 15 inches or more with an antenna as compared to 3 inches for an RFID device alone.

Figure 2A:
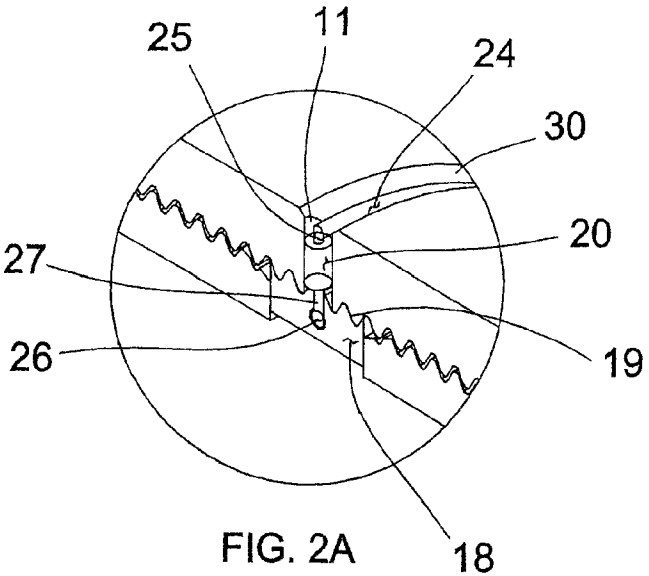
FIG. 2A is a blown up portion, as outlined in FIG. 2, of the embodiment of the process and assembly of the present invention that is illustrated in FIG. 2.
Figure 2:
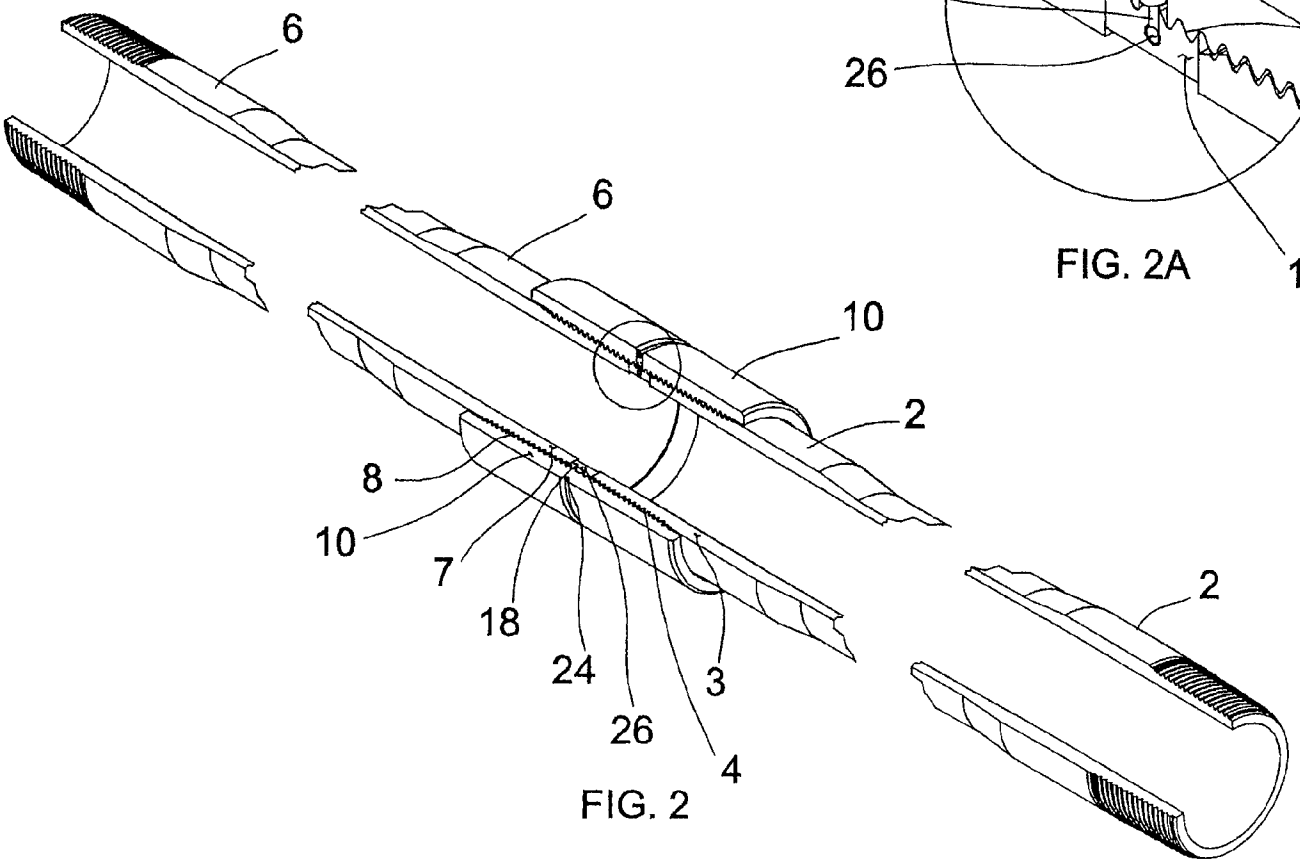
FIG. 2 is a partially cutaway, perspective view of another embodiment of the process of the present invention.

In another embodiment of the present invention that is illustrated in FIG. 2, a bore or hole 11 is provided in collar 10 and a RFID 20 is positioned in bore 11 and is electrically connected to an outer antenna 24 by any suitable means, for example by silver solder or welds 25. In accordance with the embodiment of FIG. 2, a generally annular inner antenna 26 is positioned in a ring 18 that is provided with screw threads 19 on the outer surface thereof. Threads 19 are mated with threads 12 on collar 10 such that ring 18 is positioned in the gap between the ends 3, 7 of tubulars 2, 6, respectively, as mated with collar 10. Inner antenna 26 is electrically connected with RFID by any suitable means, for example a silver solder or welds 27. The operation of this embodiment with respect to use of a transceiver 40 that is positioned outside of the tubulars is identical to that described with respect to FIGS. 1 and 4 above. However, the embodiment of FIG. 2 may also be used in conjunction with a transceiver that is transported through the bores of the tubulars (not illustrated). As thus constructed and assembled, radio frequency signals from transceiver(s) may be received from the exterior of tubulars and adjoining collars by means of outer antenna 24 and/or from the interior of tubulars and adjoining collars by means of inner antenna 26 and information from RFID 20 may be transmitted via antenna 24 to transceiver(s) located external to the tubulars and adjoining collars and/or via antenna 26 to transceiver(s) located internal to the tubulars and adjoining collars. In this manner, information transmission can occur to and/or from the exterior and/or the interior of the tubulars.

While responding device 20 and antennas 24 and 26 have been described above as connected to a collar 10, it is within the scope of the present invention to connect responding device 20 and antennas 24 and/or 26 directly to a tubular and/or to tools, equipment and/or devices, especially those used in conjunction with tubulars, in a manner substantially similar with that described above with respect to collar 10. For tubulars, such direct connection is mandatory where collars are not utilized to secure individual tubulars together as is often the case with drill strings where individual tubulars are connected to each other.

Figure 3A:
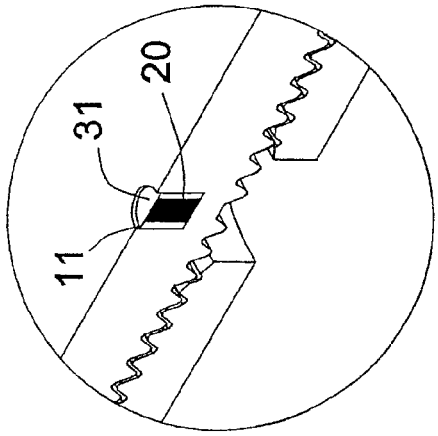
FIG. 3A is a blown up portion, as outlined in FIG. 3, of the embodiment of the process and assembly of the present invention that is illustrated in FIG. 3.
Figure 3:
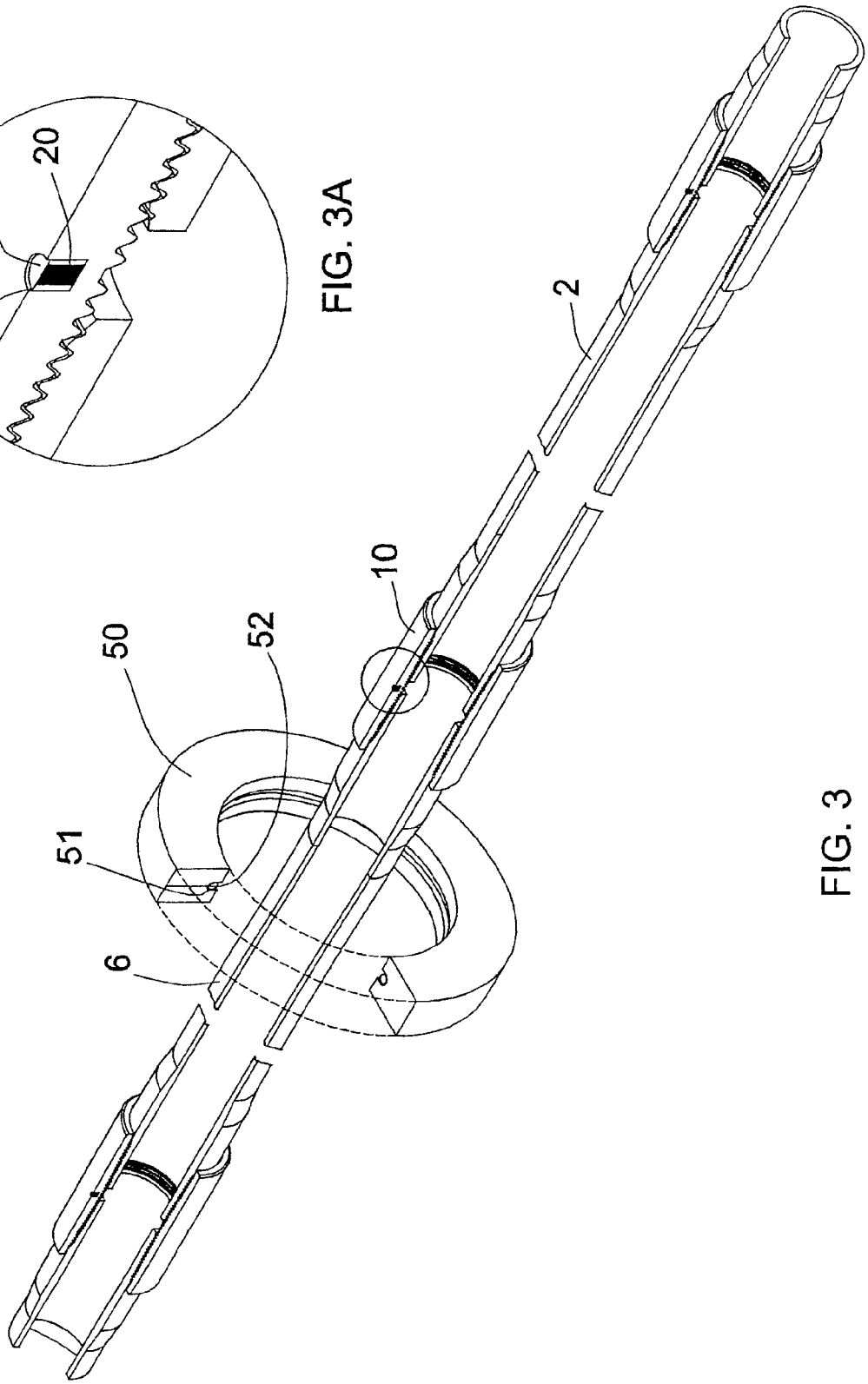
FIG. 3 is a partially cutaway, perspective view of still another embodiment of the present invention.

It is also within the scope of the present invention to utilize a conventional responding device, for example a RFID, without an associated antenna. As illustrated in FIG. 3, a RFID 20 is positioned within a bore or hole 11 formed in the outer surface of collar 10. A commercially available epoxy is placed in the bore or hole 11 and cured thereby encapsulating RFID device 20 in a fluid tight seal through which an appropriate radio frequency signal may be transmitted and received. In this embodiment, a transceiver 50 is employed which is sized and configured to permit the passage of tubulars therethrough. As illustrated, transceiver 50 is configured in a ring like shape that has an annular groove 51 formed in the inner surface thereof. An antenna 52 for the transceiver is positioned within groove 51 and extends substantially the entire length of the groove. In this embodiment, tubulars equipped with a conventional RFID may be passed through transceiver 50 with the antenna 52 ensuring that radio frequency communication between the transceiver and the RFID occurs without regard to rotational orientation of the tubulars.

While the use of an antenna in accordance with the embodiments of the present invention has been described herein only in conjunction with tubulars, it will be evident to a skilled artisan that the antenna may be used in conjunction with equipment, tools, and other devices that are secured to tubulars or to any asset that is required to be identified and tracked by use of a transceiver. Examples of such equipment, tools and devices used in conjunction with tubulars used in pipelines, subterranean wells or other fluid transmission lines, are bits, packers, plugs, pigs, valves, landing nipples, profiles, disconnects, ported subs, perforated nipples and polished bore receptacles.

While the foregoing preferred embodiments of the invention have been described and shown, it is understood that the alternatives and modifications, such as those suggested and others, may be made thereto and fall within the scope of the invention.

I claim:

1. A process for identifying and tracking assets comprising:

passing a tubular asset having a responding device connected thereto within a transceiver having an antenna so as to permit communication between said transceiver and said responding device via said antenna, said step of passing occurring without regard to rotational orientation of said tubular.

2. The process of claim 1 wherein said responding device is a radio frequency identification device.

3. The process of claim 2 wherein said radio frequency identification device is passive.

4. An assembly comprising:

at least one tubular;

a responding device secured to the exterior of said at least one tubular; and a transceiver being sized and configured to permit the passage of said at least one tubular therethrough, wherein said transceiver is substantially ring shaped and has a groove formed in an inner surface thereof.

5. The assembly of claim 4 wherein said responding device is positioned within a bore formed in the outer surface of said at least one tubular.

6. The assembly of claim 5 further comprising:

a fluid tight seal between said responding device and said outer surface of said at least one tubular.

7. The assembly of claim 4 wherein said responding device is a radio frequency identification device.

8. The assembly of claim 7 wherein said radio frequency identification device is passive.

9. The assembly of claim 4 wherein said at least one tubular comprises two tubulars, said assembly further comprising:

a collar releasably securing said two tubulars together.

10. The assembly of claim 9 wherein said responding device is positioned within a bore formed in the outer surface of said collar.

11. The assembly of claim 10 further comprising:

a fluid tight seal between said responding device and said outer surface of said collar.

12. The assembly of claim 10 wherein said responding device is a radio frequency identification device.

13. The assembly of claim 12 wherein said radio frequency identification device is passive.

14. The assembly of claim 4 wherein an antenna is positioned within and extends substantially the entire length of said groove.

15. The assembly of claim 4 wherein said groove is generally annular.

16. The assembly of claim 15 wherein said antenna is positioned within said groove.

17. The assembly of claim 16 wherein said antenna extends substantially the entire length of said groove.

* * * * *